United States Patent [19]

Nassimbene

[11] 3,954,085

[45] May 4, 1976

[54] SELF-RESTORING CHANGEABLE EXHIBITOR/KEYBOARD

[75] Inventor: Ernie George Nassimbene, Los Gatos, Calif.

[73] Assignee: International Business Machines Corporation, Armonk, N.Y.

[22] Filed: Aug. 30, 1974

[21] Appl. No.: 502,704

[52] U.S. Cl. ..... 116/124 L; 116/124.1 A; 116/DIG. 28; 200/308; 235/145 R

[51] Int. Cl.[2] ..... G08B 5/20; H01H 9/16; H01H 17/00

[58] Field of Search..... 116/DIG. 28, 130, 135, 116/124.1 R, 124.1 A, 124 L; 200/5 E, 5 EA, 5 EB, 308, 314; 40/28 C; 235/145 R; 74/483 PB

[56] References Cited

UNITED STATES PATENTS

| | | | |
|---|---|---|---|
| 3,372,501 | 3/1968 | Greene | 116/DIG. 28 |
| 3,591,749 | 7/1971 | Comstock | 200/308 |
| 3,746,802 | 7/1973 | Sandi et al. | 200/5 E |
| 3,854,018 | 12/1974 | Reynolds et al. | 200/5 E |

*Primary Examiner*—Richard C. Queisser
*Assistant Examiner*—Daniel M. Yasich
*Attorney, Agent, or Firm*—Henry E. Otto, Jr.

[57] ABSTRACT

A changeable exhibitor, with or without keyboard structure, is rendered self-restoring by use of a flexible strip arranged to lie in a selectable looped position indicative of the data being exhibited or being entered into an associated data processing system. The strip is fixed adjacent its ends and overlies a series of aligned apertures in a base. The strip is longer than the distance between its fixed ends so that it will loop into one of the apertures, one being provided for each data bit. As a different part of the strip is looped by a stylus, depressible key, or the like, into a different one of the apertures to exhibit or enter a different data bit, the first loop is concurrently and automatically recalled. A plurality of parallel independently flexible strips are arranged as a matrix exhibitor/keyboard, and bands of alternate colors aid in visually distinguishing the entered data from the unentered data. Loops in flexible strips of metal can form part of a capacitive or magnetic coupling path from an interrogation means to a transducer.

13 Claims, 10 Drawing Figures

SELF-RESTORING CHANGEABLE EXHIBITOR/KEYBOARD

BACKGROUND OF THE INVENTION

This invention relates to self-restoring, low-cost changeable exhibitors, and more particularly to those comprising a keyboard or the like to facilitate data entry.

It has heretofor been proposed to provide a low-cost molded keyboard with depressible keys which are normally biased to a raised position and, hence, remain depressed only while a depressing force is applied thereto. In some cases, keys of this type have been used to perform switching operations by capacitive coupling or closing a current path by contact.

There is a need for a relatively inexpensive exhibitor, with or without keyboard, which will exhibit entered data until new data is entered and in which the entry of the new data will automatically destroy the old data. Also, where required, it is desirable that in addition to exhibiting the entered data, the exhibitor be adapted to perform a predetermined work operation concurrently with the entry of data.

SUMMARY OF THE INVENTION

The present invention achieves these objectives by use of a flexible strip fixed at its ends and having an unfixed length sufficient to require it to remain looped into one of a plurality of aligned data-bit-representing apertures in a base member until looped into another of the apertures. The act of looping one end portion of the strip into one selectable aperture to perform a predetermined work operation automatically and concurrently withdraws the strip from the aperture into which it was previously looped, rendering the exhibitor what will hereinafter be termed as "self-restoring", in that the old data is automatically destroyed as new data is entered. The work operation may be effecting an electrical coupling (e.g., capacitive, magnetic or direct contact) with means responsive to the looping of the strip into a selected aperture to provide a unique output. To improve visual recognition of entered data, the strip is preferably divided into alternate bands of different color such that the looped strip portion at the selected bit position appears in a different color than other portions.

Other objects and advantages will become apparent from the following more detailed description of the invention and from the accompanying drawings.

DESCRIPTION OF PREFERRED EMBODIMENTS

Figure 1:
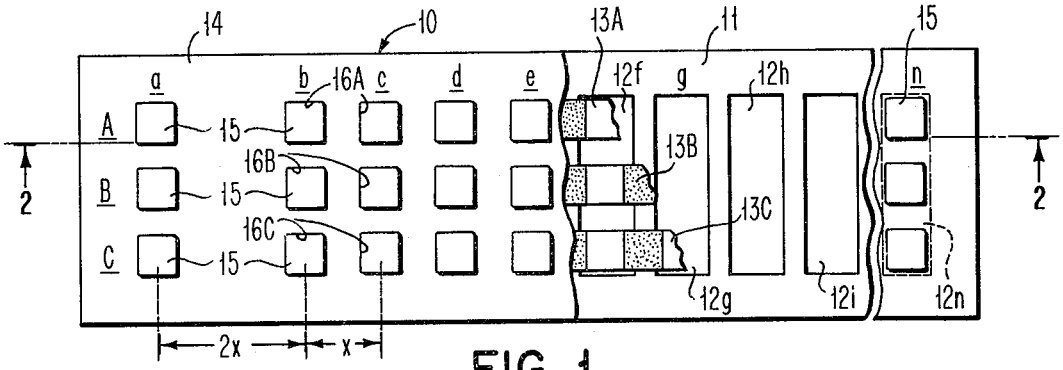
FIG. 1 is a plan view, partially broken away, of an exhibitor/keyboard device constructed according to one embodiment of the invention.
Figure 2:
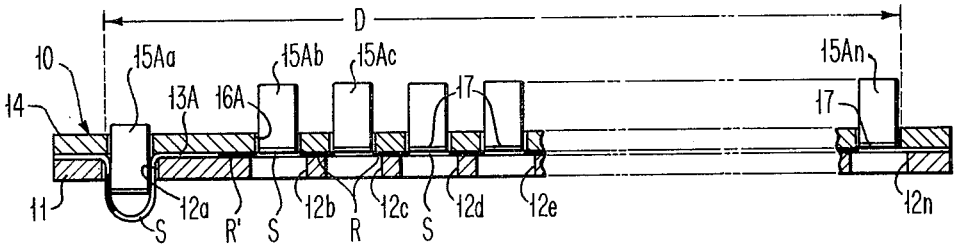
FIG. 2 is a sectional view taken along the line 2—2 of FIG. 1, showing a reset key depressed and all data keys elevated.
Figure 3:
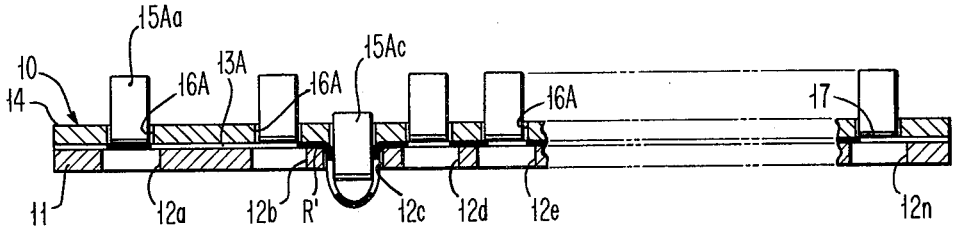
FIG. 3 is a view like FIG. 2 except with a data key depressed and all remaining keys elevated.

An exhibitor/keyboard device 10 constructed according to the embodiment illustrated in FIGS. 1–3 comprises a flat base 11 having a plurality of aligned, equal-sized apertures 12*a*, *b* . . . *n* between its ends. A plurality of flexible strips 13A, B, C are clamped or otherwise secured adjacent their ends between base 11 and an overlying cover plate 14. The unfixed length of each strip is greater than the distance between the remote ends of the farthest spaced apertures 12*a*, *n*, whereby a portion of each strip will normally be looped into one of the apertures and stretched taut across the remaining apertures.

As illustrated, a matrix array of clear plastic keys 15 is arranged in rows A, B, C and columns *a*, *b* . . . *n*. Each key is disposed above a predetermined one of the strips 13A, B, C and a particular preselected one of the rectangular apertures 12*a*, *b* . . . *n*, such that depression of a selected key will displace the particular underlying strip 13A, B or C into the underlying aperture 12*a*, *b* . . . or *n*. Each key 15 is freely reciprocable within a substantially square aperture 16A, B or C in the cover plate 14; but upward movement of each key is limited by a pair of oppositely arranged flanges 17 (see FIG. 9) that engage grooves (not shown) provided in the underside of the cover plate to prevent the key from separating from the cover plate. Note that the three apertures 16A, B, C in each column register with a respective one of the underlying rectangular apertures 12*a*, *b* . . . *n* in the base.

As shown, each strip 13 has alternate bands of stripes S, R of different colors, such as silver and red. Each band is preferably of equal width, with the total width of a band pair being substantially identical to the center-to-center distance $x$ between adjacent apertures 12*b* . . . *n*. Apertures 12*b* . . . *n* define data bit positions; whereas aperture 12*a* defines a reset position. As shown, the center-to-center distance between reset aperture 12*a* and aperture 12*b* is $2x$, but the width of intervening stripe S is intentionally longer than $\frac{1}{2}x$. This is to assure that when a reset key 15A*a* (i.e., key 15 in row A and column *a*) is depressed, as shown in FIG. 2, all portions of the underlying flexible strip 13A exposed through apertures 16A will exhibit a silver color; whereas when one of the data keys (e.g., 15A*c*) is depressed, as shown in FIG. 3, the portions of the flexible strip 13A exposed through apertures 16A underlying both the depressed key 15A*c* and reset key 15A *a* will exhibit a red color, with all portions viewable through the remaining apertures 16A exhibiting a silver color. More specifically, as key 15A*c* is depressed and key 15A*a* is thereby elevated, the strip to the left of key 15A*c* will be displaced rightward the distance *x*, causing band R′ (FIG. 2) to shift from the left to the right of key 15A*b*, as shown in FIG. 3. As illustrated in FIGS. 1–3, the unfixed length of each flexible strip 13 is exactly the distance *x* longer than the straight-line distance D between the points of affixation. This assures that only one data key 15*b* . . . *n* at a time will exhibit a color change.

Note that when one key (e.g., reset key 15A*a*) is depressed as shown in FIG. 2, it remains depressed and that all other keys 15A*b* . . . *n* are maintained in an elevated undepressed position by taut portions of the strip. As key 15A*c* is depressed to the position shown in FIG. 3, it causes the underlying portion of strip 13A to loop while concurrently and automatically drawing the portion of strip 13A underlying key 15A*a* taut to elevate the latter to undepressed position, thereby destroying the data entered by key 15A*a* and replacing it with the data entered by key 15A*c*.

Figure 9:
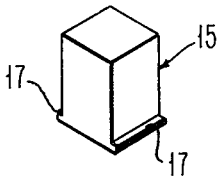
FIG. 9 is an isometric view showing a preferred form of clear plastic key for use in the various embodiments.

The keys 15 preferably have the configuration shown in FIG. 9 and are of highly polished clear plastic with a wide angle of view (e.g., 140°) and relatively short length to width ratio. This assures a wide-angle visual color indication that a key has been depressed, supplementing the indication resulting from its change in height. The color change from silver to red for a depressed data key relies only on external ambient light reflected from the highly reflective bands S, R provided on each strip 13. This is achieved by using highly reflective aluminized Mylar polyester film coated with a transparent red dye to provide the bands R. However, if high visual feedback is required in a dimly lit environment, such as an airplane cockpit, strips 13 may be transparent but with alternate opaque bands so that the data bit positions under the keys normally will be opaque; but when a key is depressed, a transparent band on the strip will move under the depressed key lighting it from a suitable single defused light source (not shown) usable for all of the keys, without requiring a single light behind each key.

Figure 10:
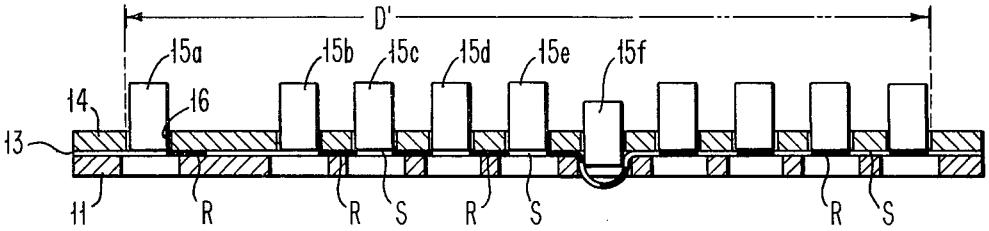
FIG. 10 is a variation of the device shown in FIGS. 1–3 in that the alternate color bands are differently disposed to achieve a different visual effect.

According to the variation illustrated in FIG. 10, the unfixed length of each flexible strip 13 would be exactly one-half the distance *x* longer than the straight line distance D′ between the points of affixation. In such case, as viewed through the aperture 16 in cover plate 14, the bands R will be seen at all data bit positions under keys 15*b* . . . *n* when reset key 15*a* is depressed; but when a data key (e.g., 15*f*) is depressed, as shown, the bands R to the left of it will shift rightward a distance ½*x* bringing the bands S into view under keys 15*a–e* for optical or visual sensing of the light colored bands S.

Figure 4:
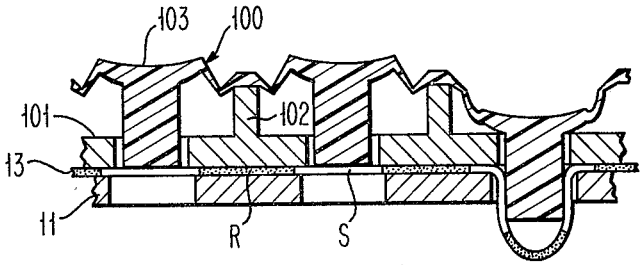
FIG. 4 is a fragmentary view, to an enlarged scale, of a variation of the invention employing a molded unitary keyboard/cover providing keys operative with a toggle-like action.

According to the variation illustrated in FIG. 4, a unitary keyboard/cover member 100 is provided of molded flexible material. A guide plate 101 below member 100 not only provides guide channels for receiving each flexible strip 13 but also has upstanding integrally formed interconnecting annular ridges 102 that support the member radially outward of each depressible key portion 103 to assure that any key portion that is depressed will remain depressed by an overcenter toggle-like flexure at each ridge until restored to elevated undepressed condition by depression of another one of the key portions. The key portions 103 are transparent so as to display one of the colored bands R on strip 13 below each key portion when it is depressed.

The embodiment illustrated in FIGS. 5 and 6 differs from that in FIGS. 1–3 in that a printed circuit board 200 is spaced below base 11, and the strips 13A′, B′, C′ are of conductive material such as aluminized polyester film. Board 200 has a plurality of independently energizable circuits 201*a* . . . *n* extending in the "Y" direction and overcoated with a dielectric film 202. Each circuit 201*a* . . . *n*, when energized, drives a respective transistor 203*a* . . . *n* into conduction to provide an output that initiates a desired control operation.

Assuming that one key 15 is depressed in each row A, B, C, the data thus entered can be read selectively and/or sequentially by applying a high frequency signal to each strip 13A′, B′, C′ selectively or sequentially from a suitable signal generator (not shown) electrically connected to one end of each strip. By capacitive coupling between the conductive loop (illustrated as below reset key 15A*a* in FIG. 5) and the associated underlying circuit 201*a*, a signal is generated which activates the associated transistor 203*a*. Note that since only one key 15 at a time can be depressed for each strip, only one circuit at a time can be capacitively coupled by the proximity of the loop with the circuit; hence, sensing is simplified because the circuits 202 need only determine which one of the key positions 15*a* . . . *n* has the greatest signal (i.e., is at the site of the loop) when each strip is selectively or sequentially energized. Capacitive coupling provides higher tolerance to grease and dirt than coupling by direct contact.

Figure 5:
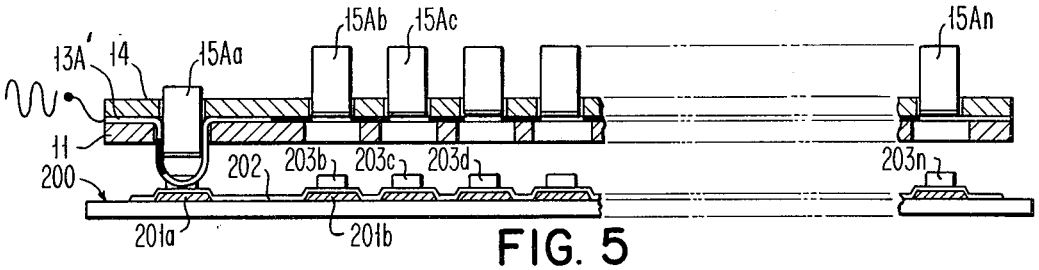
FIG. 5 is a vertical sectional view of another embodiment of the invention in which an exhibitor/keyboard of the type in FIG. 2 is associated with a printed circuit board or the like to provide a read-out of the exhibited data by capacitive coupling.
Figure 6:
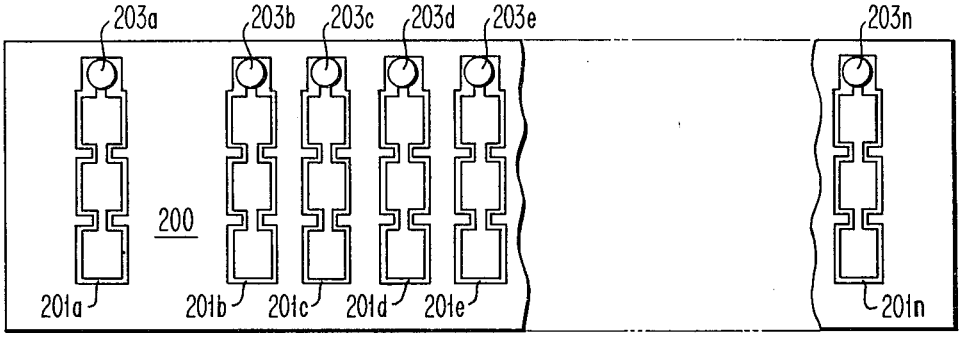
FIG. 6 is a plan view of the printed circuit board of FIG. 5.
Figure 7:
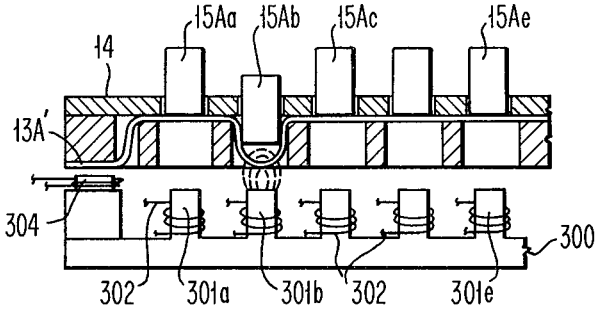
FIG. 7 is a view like FIG. 5 except with sequentially energizable electromagnets substituted for the printed circuit board to provide read-out of exhibited data by magnetic coupling.

The variation illustrated in FIG. 7 is substantially identical with that in FIGS. 5–6 except that a substrate 300 supporting electromagnets 301*a*, *b* . . . *n* replaces the printed circuit board 200, circuits 201 and transistors 203. Electromagnets 301*a* . . . *n* are selectively or sequentially energizable via respective windings 302 from a suitable selector switch or other source (not shown). When a particular key (e.g. 15A*b*) is depressed, as shown, the loop of strip 13A′ will be close to magnet 301*b*. When magnet 301*b* is energized, a signal generated in the strip by magnetic coupling will be sensed by a Hall effect transducer 304.

Figure 8:
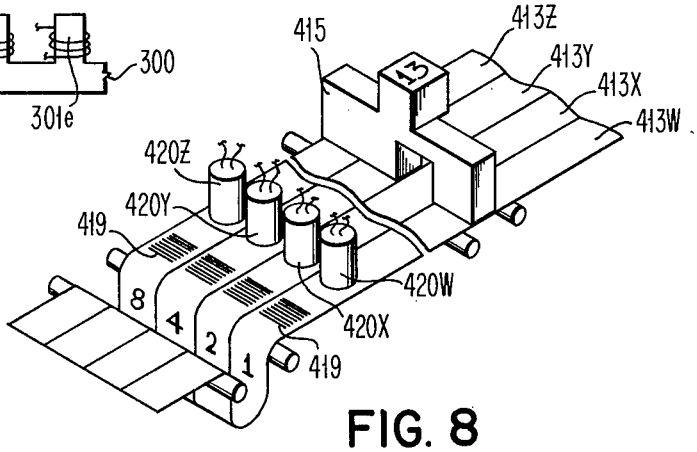
FIG. 8 is a schematic perspective view illustrating another embodiment of the invention employing a plurality of flexible strips assigned binarily weighted values and displaceable by keys in different combinations according to the predetermined value assigned to each key to provide a corresponding read-out signal.

According to the embodiment schematically shown in FIG. 8, a plurality of flexible strips 413 W, X, Y, Z are assigned binarily weighted different numbers (e.g., 1, 2, 4, 8). These strips are displacable by a series of keys 415 (only one of which is shown) in different combinations according to the predetermined value assigned to each such key to shift appropriate ones of the strips. Each strip 413 has marks 419 (e.g., of black ink or magnetic ink) which are adapted to be sensed optically or magnetically (as the case may be) by a respective photocell or read head 420 W, X, Y, Z when the particular underlying strip is shifted and moves the mark 419 under the read head. Assume initially that all strips 413 are looped into a reset position, as shown in FIG. 8, by a reset key (not shown). If key 415 (which represents a decimal "13") is now depressed, strips 413 W, Y, Z (but not 413X) will be displaced rightward, causing the read heads to detect and read out a binary coded decimal "13". It will be understood that keys (not shown) to either side of key 415 will shift those strips 413 appropriate to provide binary coded decimal outputs ranging from 1 to 15.

It will be understood that, if preferred, the separate flexible strips 13 A, B, C or 419 W, X, Y, Z may be replaced by a single flexible sheet slit into strips which are independently movable relative to the unslit end portions of the sheet which are clamped between the base and cover. It should also be noted that while depression by keys or a stylus is preferred, the strips may be deppressed by hand. Moreover, if desired, sensing of the loops in the respective flexible strips may be effected mechanically (e.g., by a movable star wheel unit, or a microswitch located under each key).

While the invention has been shown and described with reference to preferred embodiments and variations thereof, it will be apparent that the foregoing and other changes may be made in the self-restoring changeable exhibitor devices without departing from the spirit, scope and teaching of the present invention. Accordingly, the devices herein disclosed are to be considered merely as illustrative, and the scope of the invention is to be limited only as specified in the claims.

The invention claimed is:

1. A self-restoring changeable exhibitor structure comprising:

a base means having a plurality of apertures aligned therein between the ends thereof;

a flexible strip affixed adjacent its ends to said base means and overlying all of said apertures;

said flexible strip having an unfixed length greater than the distance between the remote ends of the farthest spaced apertures in said base means to cause one portion of said strip normally to be looped into one of said apertures, said one portion being adapted to be withdrawn from said one aperture concurrently with and incident to the looping of another portion of said strip into another of said apertures, said strip having portions with optically different characteristics such that any of said portions, while looped into a respective one of the apertures, reflects ambient light differently than other portions.

2. A self-restoring changeable exhibitor structure as defined in claim 1, further comprising:

cover means overlying said flexible strip and having apertures in registry with said apertures in said base means.

3. A self-restoring changeable exhibitor structure as defined in claim 2, wherein the unfixed length of the flexible strip is divided transversely into bands of two different colors, and the apertures and bands are so spaced in relation to the unfixed length of said flexible strip that, as viewed through the apertures in said cover means, any portion of the strip looped into any of said apertures will exhibit one color and all other portions of the strip will exhibit the other color.

4. A self-restoring changeable exhibitor structure as defined in claim 2, wherein the unfixed length of the flexible strip is divided transversely into bands of two different colors, and the apertures and bands are so spaced in relation to the unfixed length of said flexible strip that, as viewed through the apertures in said cover means, all portions of the strip to one side of the loop will appear one color and all to the opposite side will appear the other color.

5. A self-restoring changeable exhibitor structure as defined in claim 2, wherein there are at least three apertures, one of which is a reset aperture, and the unfixed length of the flexible strip is divided transversely into bands of two different colors with the apertures being so spaced in relation to the unfixed length of said flexible strip, that as viewed through the apertures in said cover means, when the strip is looped into the reset aperture, all portions of the strip exhibit one color and when the strip is looped selectively into any of the remaining apertures, both the looped portion of the strip and the portion overlying the reset aperture exhibit the other color.

6. A self-restoring changeable exhibitor structure as defined in claim 1, further comprising:

keyboard means including a plurality of keys each arranged in registry over a corresponding one of said apertures in said base means and selectively depressible to loop said strip into the associated underlying aperture in said base means.

7. A self-restoring changeable exhibitor as defined in claim 6, wherein said keys are part of and formed integrally with a cover means that overlies the strip and is sealingly secured to the base means.

8. A self-restoring changeable exhibitor structure as defined in claim 6, wherein said keyboard means is premolded into a unitary structure having integrally formed keys, each selectively depressible with a toggle-like action and restorable with a toggle-like action by the strip upon depression of a different one of said keys, said unitary structure also serving as a cover member sealingly overlying the strip and apertures.

9. A self-restoring changeable exhibitor as defined in claim 6, wherein said keys are optically transparent, and said flexible strip is divided into alternate bands having first and second optically different characteristics visible through undepressed and depressed keys, respectively.

10. A self-restoring changeable exhibitor and keyboard structure comprising:

a base member having a plurality of apertures aligned therein between the ends thereof;

a flexible strip having its ends affixed to said base member and overlying all of said apertures;

said strip having an unfixed length greater than the distance between the remote ends of the farthest spaced apertures in said base member to cause a portion of said to be strip looped into one of said apertures;

a plurality of depressible keys, each overlying a respective one of said apertures, depression of one of said keys serving to loop a related portion of said strip into the aperture beneath that key and concurrently cause a previously looped portion of the strip to be drawn taut and restore a previously depressed key to an undepressed condition;

said keys being substantially transparent and said strip having portions with optically different characteristics such that, as viewed through the keys, any of said portions while looped into a respective one of the apertures reflects ambient light differently than other portions.

11. A self-restoring changeable exhibitor and keyboard structure as defined in claim 10, including an apertured cover plate across which the strip is taut, and wherein said flexible strip is divided into sets of alternate transverse bands, those bands of one set appearing in apertures in said cover plate, and one band of the other set appearing in that one of the apertures into which the strip is looped.

12. A self-restoring changeable exhibitor and keyboard structure as defined in claim 11, wherein said alternate bands are of different color.

13. A self-restoring changeable exhibitor and keyboard structure comprising:

means defining a base providing a matrix array of rows and columns of aligned apertures;

means providing independently flexible strips affixed to said base and each overlying all of said apertures in a respective one of said rows;

each strip having an unfixed length greater than the distance between the remote ends of the farthest spaced apertures in the corresponding row to cause a portion of each strip normally to be looped into an independently selectable one of said apertures in said corresponding row; and a plurality of depressible transparent keys, each overlying a respective one of said apertures, depression of a selectable one of said keys in each of said rows serving to loop a related portion of the associated strip into the aperture beneath that key and concurrently cause a previously looped portion of the associated strip to be drawn taut and restore a previously depressed key to an undepressed condition, each of said strips being divided transversely into bands having optically different characteristics such that that portion of each strip which is looped into a respective one of the apertures will reflect light differently through its overlying key than the portions of such strip which then underlie at least some of the remaining keys.

* * * * *